United States Patent [19]

Trask

[11] 4,232,087

[45] Nov. 4, 1980

[54] METHOD OF COATING ORGANIC FIBERS WITH POLYTETRAFLUOROETHYLENE

[75] Inventor: Elwood G. Trask, Auburn, Me.

[73] Assignee: Albany International Corp., Albany, N.Y.

[21] Appl. No.: 930,805

[22] Filed: Aug. 3, 1978

[51] Int. Cl.[3] ..... B32B 27/34; D02G 3/36

[52] U.S. Cl. ..... 428/389; 210/508; 427/393.4; 427/393.5; 427/421; 427/428; 427/434.6; 428/263; 428/264; 428/265; 428/267

[58] Field of Search ..... 427/390 E, 385 B, 445, 427/421, 434 D, 428; 428/395, 263, 264, 265, 267, 389; 210/508

[56] References Cited

U.S. PATENT DOCUMENTS

| | | | |
|---|---|---|---|
| 2,843,502 | 7/1958 | Fay, Jr. et al. | 428/263 |
| 3,034,925 | 5/1962 | DeMarco et al. | 428/263 |
| 3,476,532 | 11/1969 | Hartman | 427/390 E X |
| 3,540,923 | 11/1970 | Rozek | 427/390 E X |
| 3,881,047 | 4/1975 | Massy et al. | 427/390 E X |
| 3,995,085 | 11/1976 | McCown | 427/390 E X |
| 4,073,993 | 2/1978 | Lark | 427/390 E X |
| 4,107,368 | 8/1978 | Ratcliffe et al. | 428/245 |
| 4,125,673 | 11/1978 | Roth et al. | 427/390 E X |

*Primary Examiner*—Ronald H. Smith
*Assistant Examiner*—Thurman K. Page
*Attorney, Agent, or Firm*—Kane, Dalsimer, Kane, Sullivan and Kurucz

[57] ABSTRACT

The disclosure is of a method for improving the acid resistance, hydrophobicity, oleophobicity and dust or dirt release properties of synthetic organic fibers. The method comprises coating the fibers with an aqueous dispersion of polytetrafluoroethylene particles in the presence of a water soluble, chromium complex of a long chain fluorochemical. The method is particularly advantageous for improving polyaramid fibers such as Nomex fibers in fabrics to be used as a filter means.

9 Claims, No Drawings

METHOD OF COATING ORGANIC FIBERS WITH POLYTETRAFLUOROETHYLENE

BACKGROUND OF THE INVENTION

1. Field of the Invention

The invention relates to the chemical treatment of synthetic organic fibers and fabrics and more particularly relates to a method of coating organic fibers with polytetrafluoroethylene.

2. Brief Description of the Prior Art

Prior hereto it was known that synthetic and/or inorganic fabrics such as glass fabrics could be coated with polytetrafluoroethylene to improve their soil release properties and to enhance their durability; see for example U.S. Pat. No. 3,968,297. In the latter patent, the method of coating comprises first applying a base coat of a tetravalent titanium oxide polymer, a zirconium oxide polymer or a tin oxide polymer. The base coat is then top coated with an unsintered aqueous dispersion of polytetrafluoroethylene particles.

It has also been proposed heretofore to coat elastomeric materials such as butadiene-acrylonitrile copolymers with unsintered polytetrafluoroethylene particles by first softening the polymer surface with a solvent and adhering the polytetrafluoroethylene particles to the softened surface; see for example U.S. Pat. No. 3,200,006. In U.S. Pat. No. 3,511,682 a method is described wherein the elastomer is coated with a thin film of polytetrafluoroethylene and then the film is sintered with an open flame on the elastomer surface.

It will be appreciated by those skilled in the art that the prior art methods of coating both inorganic and organic materials requires multiple treatment steps, specific base coats, solvents and/or sintering with relatively high temperatures. Such procedures may weaken certain synthetic organic fibers and fabrics such as polyaramids. By the method of my invention, synthetic organic fibers and fabrics such as polyaramids may be coated with polytetrafluoroethylene, improving their soil release characteristics, acid resistance, hydrophobicity and oleophobicity in a single step, without the need for solvents, flames, exotic base coats and the like. The method of my invention does not adversely affect the treated fibers, i.e.; does not weaken, stiffen or otherwise alter the desired basic properties for which the fibers and fabrics were selected. The method of my invention is particularly advantageous for the treatment of filter fabrics prepared from synthetic, organic fiber materials. The treated filter fabrics are particularly useful for air filtration under circumstances wherein the filter fabric will be exposed to acid vapors.

SUMMARY OF THE INVENTION

The invention comprises a method of improving the acid resistance, hydrophobicity, oleophobicity and soil release properties of synthetic, organic fibers, which comprises; coating the fibers with polytetrafluoroethylene particles, in the presence of water and a water soluble, chromium complex of a long chain fluorochemical characterized in part by a molecular structure which consists of a polar end and a non-polar fluorocarbon end which is both organophobic and hydrophobic.

The term "chromium complex of a long chain fluorochemical" as used herein means a compound which comprises a chromium coordination complex with a fluorine substituted hydrocarbon moiety, including amine substituted and sulfonyl amine substituted alkyls having at least 6 carbon atoms and preferably 6 to 30 carbon atoms inclusive.

DETAILED DESCRIPTION OF THE PREFERRED EMBODIMENTS OF THE INVENTION

The method of the invention may be used to improve the acid resistance, hydrophobicity, oleophobicity and soil release characteristics of a wide variety of synthetic, organic fibers such as, for example, polyamides, polyesters, polyolefins and the like. The method is particularly advantageous to treat polyaramids such as for example fibers of Nomex. In a preferred embodiment of the invention, filter fabrics of Nomex fibers and yarns are treated to improve the aforementioned properties. The filter fabrics which may be treated by the method of the invention may be woven or non-woven fabrics or composites thereof such as woven scrims to which there is needled a non-woven web.

Coating of the organic fibers and fabrics thereof may be carried out by conventional technique of applying an aqueous dispersion to a fiber or fabric, e.g. by spraying, roll or bar coating application, dipping and like techniques. Preferably, the fibers to be coated are in the form of a woven or non-woven fabric which is treated by immersion in the aqueous dispersion of the polytetrafluoroethylene particles. Immersion of the fabric may be followed by compression or other means of partially removing excess aqueous dispersion from the immersed fabric. This is to control the quantity of aqueous dispersion retained in the fabric substance. The wet fabric may then be dried by any conventional means, for example in a tenter dryer, under radiant or microwave heaters and the like. The add on of polytetrafluoroethylene particles is preferably within the range of from about 2 to 10 percent by weight of the fabric, most preferably about 6 percent. In the preferred embodiment method of the invention, the polytetrafluoroethylene particles are supplied in a size having an average of from about 0.05 to about 0.5 microns in diameter.

Necessary to the method of the invention is add on of the polytetrafluoroethylene particles in the presence of a water soluble, chromium complex of a long chain, fluorochemical characterized in part by a molecular structure which consists of a polar end or head and a non-polar tail end which is both organophobic and hydrophobic. Although I am not to be bound by any theory of operation, I believe that in the method of my invention the polar head of the complex compound complexes with the fiber body and the polytetrafluoroethylene particles are attracted to and held by van der Waals forces, to the non-polar fluorocarbon tail of the coordination complex. Thus, the chromium complex acts as a unique chemical coupler between the organic fiber and the polytetrafluoroethylene particles, to provide a highly stable and advantageous coating.

In the preferred method of the invention, the fluorochemical is added on to the fabric so as to add from about 0.3 to 1.5 percent by weight, preferably 0.7 percent to the fabric weight.

The method of the invention may be carried out at any convenient temperature, the temperature not being critical. For practical purposes, the practice of the invention may be carried out at temperatures within the range of from about 20° to 50° C. Most preferably, the method of the invention is carried out at room temperature.

Following the coating of the fibers and/or fabrics with the polytetrafluoroethylene particles in the presence of the fluorochemical, the treated fabric is dried. Following drying of the fabric, it may be advantageous to cure the coated fibers by exposure to heat for a short period of time. Preferably, curing is carried out at a temperature of from about 300° to about 350° F. for a period of time ranging from about 15 to about 30 minutes.

The following example describes the manner and process of making and using the invention and sets forth the best mode contemplated by the inventor of carrying out the invention but is not to be construed as limiting. In carrying out the example, the following tests were employed:

Breaking strenth:

Performed as described in ASTM D1682, 37 Breaking Load and Elongation of Textile Fabrics".

Flexibility:

Flex endurance was determined utilizing a Tinius Olson M.I.T. Folding Endurance Tester, with 0.07" jaw and 5 lb. weight for needled fabrics and 0.03" jaw and 5 lb. weight for woven fabrics. Sample width 0.5". Results reported in number of complete flex cycles to failure.

Air permeability:

Determined according to testing procedure set forth in ASTM D737 "Air Permeability of Textile Fabrics".

Acid resistance:

Test pieces were immersed in 2 percent sulfuric acid for 15 minutes and then exposed to heat (300° F.) for 30 minutes. The immersion was then repeated followed by a second exposure to heat at 300° F. for 30 minutes. The fabric was then tested for strength and flex endurance, using untreated fabric as a control.

Water repellency:

Determined according to the testing procedure set forth in AATCC Test Method 21-1972 "Water Repellency: Static Absorption Test".

Oil repellency:

The resistance to wetting by oil determined by observing the propensity of the fabric to wet out by mineral oil (Nujol).

EXAMPLE 1

An aqueous dispersion is prepared by admixture of 2 parts of the chromium (Cr III) complex of N-ethyl-N-heptadecylfluorooctane sulfonyl glycine in isopropyl alcohol (52 percent) and water (15 percent), (FC 805, Minnesota Mining and Manufacturing Co., Minneapolis, Minn.), 10 parts of polytetrafluoroethylene resin dispersion (Teflon 30, E. I. DuPont de Nemours and Co.) and 88 parts of water. The mixture is agitated to provide a uniform dispersion.

A supported, non-woven filter fabric weighing 14 oz/yd$^2$, comprised of Nomex fiber webs needled to both sides of a woven Nomex scrim is provided. The fabric is immersed in the above-described dispersion and then compressed (squeezed) to remove excess dispersion. The fabric is then dried in a tenter dryer at 240° F. and the coating cured for 15 minutes at 350° F.

The resulting treated fabric is then examined for its physical properties and compared to the properties of the untreated fabric. The results of the examination are shown in Table 1 below.

TABLE 1

| | Untreated Fabric | Treated Fabric |
|---|---|---|
| Weight | 14.0 oz/yd$^2$ | 14.9 oz/yd$^2$ |
| Breaking Strength*, lbf/2" | 200 | 190 |
| Flexibility*, cycles | 263,694 | 158,852 |
| Air Permeability, cfm/ft$^2$ at 0.5" $H_2O$ | 26.0 | 23.5 |
| Acid Resistance | | |
| Breaking Stength*, lbf/2" | 22 | 190 |
| Flexibiity*, cycles | 0 | 135,076 |
| Water Repellency | 59.0% | 19.3% |
| Oil Repellency | Soaked in immediately | No wetting after 24 hrs. |

*Test performed in the machine direction

From the above Table 1, those skilled in the art will appreciate the enhanced water repellency, oil repellency, and acid resistance obtained in the fabric treated according to the method of the invention. The treated fabric is also observed to exhibit enhanced soil or dust release characteristics over the untreated fabric.

What is claimed:

1. A method of improving the acid resistance, hydrophobicity, oleophobicity and soil release properties of synthetic, organic fibers, which comprises;

coating the fibers with polytetrafluoroethylene particles, in the presence of water and a water soluble, chromium complex of a long chain fluorochemical characterized in part by a molecular structure which consists of a polar end and a non-polar fluorocarbon end which is both organophobic and hydrophobic.

2. The method of claim 1 wherein said chromium complex is the chromium (Cr III) complex of N-ethyl-N-heptadecylfluorooctane sulfonyl glycine.

3. The method of claim 1 wherein said particles have an average diameter of from 0.05 to 0.5 microns.

4. The method of claim 1 wherein the coating adds from 2 to 10 percent by weight to the fibers.

5. The method of claim 1 wherein the organic fibers are polyaramid fibers.

6. A method of improving the acid resistance, hydrophobocity, oleophobicity and soil release properties of polyaramid fibers, which comprises;

coating the fibers with polytetrafluoroethylene particles, in the presence of water and the chromium (Cr III) complex of N-ethyl-N-heptadecylfluorooctane sulfonyl glycine so as to add on from about 2 to about 10 percent by weight of said particles and from about 0.3 to 1.5 percent by weight of said complex to the fibers weight.

7. The method of claim 6 wherein 0.7 percent of the final fabric weight is added on by the complex.

8. The product of the method of claim 6.

9. The method of claim 1 wherein said fibers are in a non-woven fabric.

* * * * *